US009969051B2

(12) United States Patent
Lafon et al.

(10) Patent No.: US 9,969,051 B2
(45) Date of Patent: May 15, 2018

(54) HOLDER FOR PNEUMATICALLY BLOCKING AN OPTICAL LENS

(71) Applicant: ESSILOR INTERNATIONAL (COMPAGNE GENERALE D'OPTIQUE), Charenton-le-Pont (FR)

(72) Inventors: Fabien Lafon, Charenton-le-Pont (FR); Hanna Sauze, Charenton-le-Pont (FR)

(73) Assignee: ESSILOR INTERNATIONAL (COMPAGNIE GENERALE D'OPTIQUE), Charenton-le-Pont (FR)

( * ) Notice: Subject to any disclaimer, the term of this patent is extended or adjusted under 35 U.S.C. 154(b) by 178 days.

(21) Appl. No.: 15/039,225

(22) PCT Filed: Oct. 31, 2014

(86) PCT No.: PCT/FR2014/052777

§ 371 (c)(1),
(2) Date: May 25, 2016

(87) PCT Pub. No.: WO2015/079134

PCT Pub. Date: Jun. 4, 2015

(65) Prior Publication Data

US 2017/0157739 A1 Jun. 8, 2017

(30) Foreign Application Priority Data

Nov. 27, 2013 (EP) ..... 13306627

(51) Int. Cl.
*B24B 41/06* (2012.01)
*B24B 13/005* (2006.01)

(52) U.S. Cl.
CPC ..... *B24B 41/061* (2013.01); *B24B 13/005* (2013.01)

(58) Field of Classification Search
CPC ..... B24B 41/06; B24B 41/061; B24B 13/005
(Continued)

(56) References Cited

U.S. PATENT DOCUMENTS 2,573,668 A * 10/1951 Long ..... B24B 13/005 33/507
3,328,042 A * 6/1967 Mallory ..... C03B 23/0093 279/151

(Continued)

FOREIGN PATENT DOCUMENTS

| | | |
|---|---|---|
| DE | 100 57 228 A1 | 5/2002 |
| FR | 2 863 520 A1 | 6/2005 |
| WO | 2012143621 | 10/2012 |

OTHER PUBLICATIONS

International Search Report, dated Jan. 29, 2015, from corresponding PCT Application.

*Primary Examiner* — Robert Rose
(74) *Attorney, Agent, or Firm* — Young & Thompson

(57) ABSTRACT

A holder (1) for pneumatically blocking an optical lens (300) on a surfacing machine, includes:—a gripping part (10) for fixing it to a corresponding member (200) of the surfacing machine, and—a part (100) for blocking the optical lens, which includes a body (110) from which there protrude abutments which are designed to afford the optical lens a rigid seat, and a seal (170) against which the optical lens is able to be brought to bear in order to delimit with the body a vacuum chamber (180). The abutments include first rods (160) which are mounted so as to be movable in translation with respect to the body in order to bear by way of their free ends (161) against the optical lens, and provision is made of return elements (179, 190) for returning the first rods against the optical lens.

13 Claims, 2 Drawing Sheets

(58) Field of Classification Search
USPC ..... 451/384, 390, 388, 460, 364, 41
See application file for complete search history.

(56) References Cited

U.S. PATENT DOCUMENTS

| | | | | |
|---|---|---|---|---|
| 5,421,770 | A * | 6/1995 | Bobst | B24B 13/005 451/162 |
| 5,785,580 | A | 7/1998 | Cook | |
| 7,066,794 | B2 * | 6/2006 | Granziera | B24B 13/012 451/158 |
| 9,089,948 | B2 * | 7/2015 | Schafer | B24B 13/02 |
| 2007/0105490 | A1 | 5/2007 | Achy et al. | |
| 2008/0305723 | A1 * | 12/2008 | Philipps | B24B 13/02 451/158 |

* cited by examiner

Fig.1
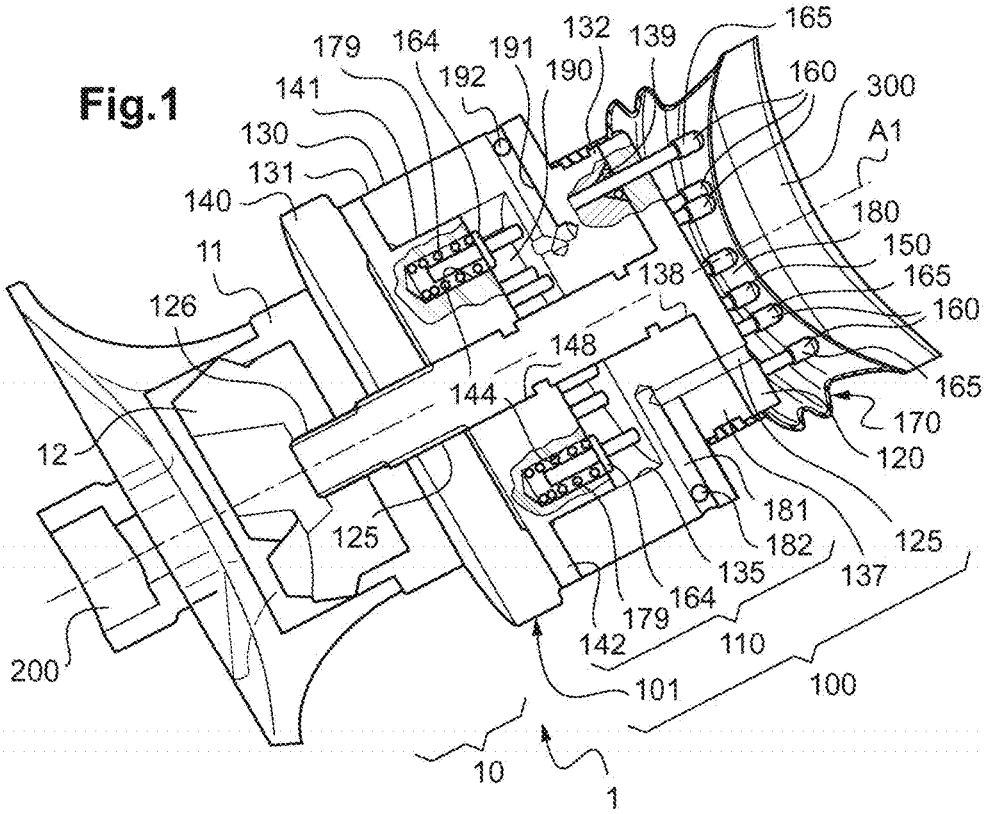
Fig.2
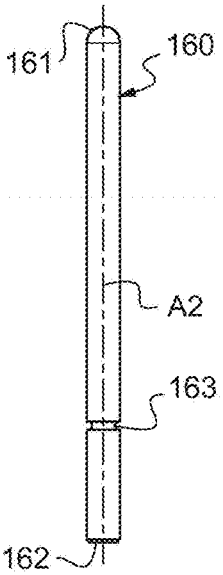
Fig.3
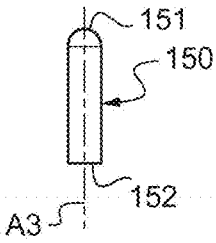
Fig.5
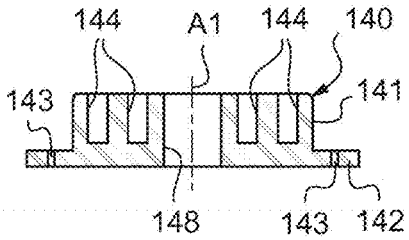
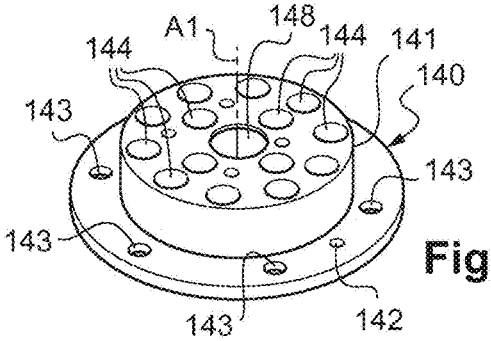
Fig.4

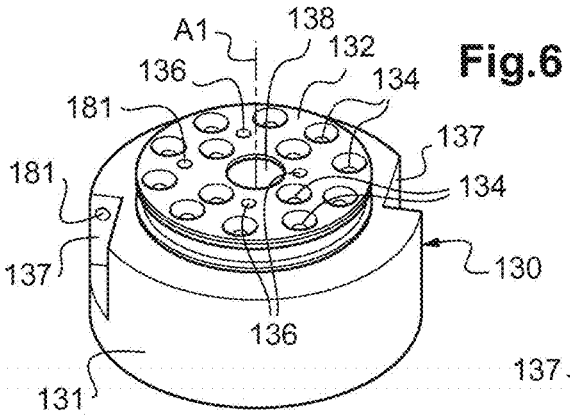
Fig.6
Fig.7
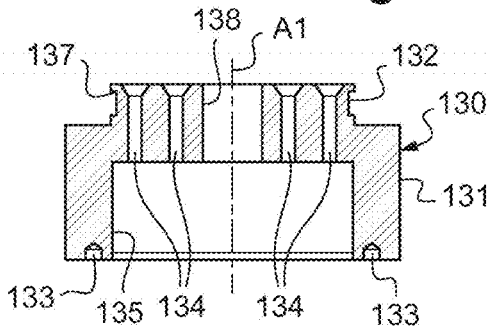
Fig.8
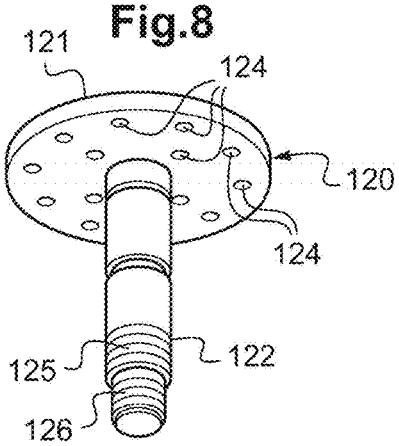
Fig.9
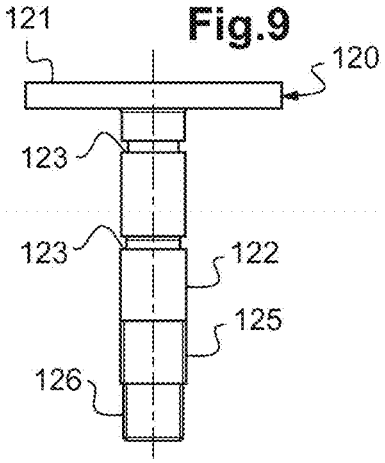
Fig.10
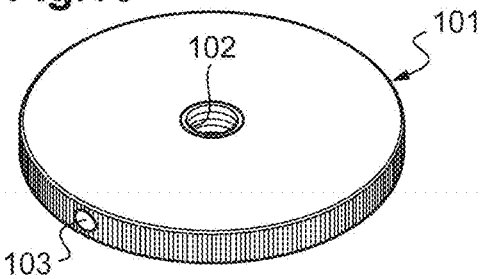
Fig.11
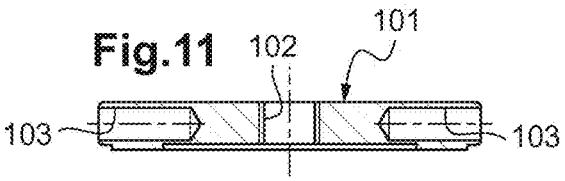

HOLDER FOR PNEUMATICALLY BLOCKING AN OPTICAL LENS

TECHNICAL FIELD OF THE INVENTION

The present invention relates in general to the manufacture of optical lenses such as ophthalmic and/or solar-protection spectacle lenses, objective lenses, etc.

It relates more particularly to a pneumatic blocking support for blocking an optical lens on a surfacing machine, comprising:

holding part for fixing it to a corresponding member of said surfacing machine, and a lens-blocking part for blocking said optical lens and which comprises a body from which there project stops arranged to offer the optical lens a rigid footing, and a seal against which the optical lens is able to be made to bear so as to delimit with said body a reduced-pressure chamber.

It relates in particular to the blocking of such a lens while it is being surfaced.

TECHNICAL BACKGROUND

The process of manufacturing optical lenses, and in particular corrective ophthalmic lenses, requires a particularly high level of care and precision. It generally involves two main steps. First of all, a semi-finished lens, also referred to as a blank disk or preform, is obtained by molding the synthetic or inorganic material selected from which to make the base substrate of the lens. Next, the molded semi-finished lens is surfaced on one and/or other of its two optical faces in order to conform to the prescribed geometric model and prescribed correction.

Because of the stringent requirements regarding precision and roughness to which it is subject, this surfacing operation is broken down into several sub-steps associated with the same number of specific workstations. Thus, in general, for the surfacing of each face of the lens, a distinction is made between a machining workstation which performs both the rough-cutting and the finishing using two distinct tools, and a polishing workstation which may potentially be preceded by a smooth-grinding workstation.

One of the most specific problems encountered during the course of this lens-surfacing process lies in the mounting of the lens on each workstation with a positioning that is precise and well controlled. This recurring intermediate operation of picking up the workpiece over and over again, commonly referred to as the lens-blocking operation, is particularly tricky and expensive and often gives rise to imprecisions in positioning which are capable of significantly deteriorating the optical quality of the finished lens. In fact, this lens blocking is subject to two cumulative and opposing requirements.

First of all, the lens, made of transparent synthetic or inorganic material and not yet coated, is relatively fragile and needs to be spared any marking or cracking, especially on the one of its two faces that is finished, while its other face is in the process of being worked. The risk of marking is particularly pronounced with synthetic materials.

In addition, and above all, the lens needs to be positioned on each workstation concerned very precisely, with a spatial orientation that is known and stable in a determined frame of reference of the workstation concerned. This requirement of geometric stability of the blocking is particularly steep and difficult to meet in the case of the manufacture of lenses with complex surfaces such as varifocal or customized lenses which do not have symmetry of revolution. Indeed it will be appreciated that the surfacing of such lenses is accompanied by variations in cutting force that vary according to intense gradients thereby giving rise to deformations the result of which is relative geometric instability of the blocking of the lens.

Several ways of "blocking" a blank or semi-finished lens for mounting it and rotationally driving it on the machine tools or measurement apparatuses of the various workstations and, in particular, surfacing workstations, are known. Traditionally, use is made of a blocking support, sometimes also referred to as a holder block or chuck, which on the one hand has blocking means to accept and immobilize the lens via one of the main faces thereof and on the other hand has means for fixing this support to the tip of the various machine tools or measurement and control apparatus, so as to block the lens, if appropriate allowing it to be rotationally driven, on the machine or the apparatus.

The main difficulty lies in how to block the lens on this support, because of the requirements mentioned hereinabove.

The most widespread method in use at the present time, because of its geometric precision, is to use casting to cast a low melting point molten alloy onto one of the faces of the lens to form a metallic block that acts as a blocking support and that has means of fixing it to the tip of the machine tools of the various workstations involved.

This method is satisfactory overall in terms of its precision and stability, but has a number of disadvantages of an economic and environmental nature that make it necessary to look for alternative blocking means. The low melting point alloys used are in fact relatively high in cost and need to be considered as pollutants that are hazardous to the environment, which means that both for economical reasons and because of increasing environmental requirements, it is necessary to organize the recycling thereof very carefully. However, even with effective recycling, losses of alloy through evaporation at the time of melting cannot be avoided. There is also, for technical reasons, a minimum length of time (approximately 15 minutes) that needs to elapse before the lens associated with its holding block can be used on a machining workstation, and a maximum length of time (approximately 24 hours) beyond which the machining will no longer be able to be carried out; these times therefore impose requirements on the workflow of said lenses.

In order to avoid the use of a molten metal alloy, the idea of using, for example a wax, to bond the lens to a corresponding face of the blocking support, having approximately the same curvature, has been conceived of. However, this solution, just like the meltable metal block solution incidentally, presents practical problems regarding unblocking, namely the disassembling of the lens from the support, and the cleaning of the lens, with the ensuing environmental repercussions. Above all, the precision and stability with which the lens is fixed to the support may prove insufficient. The geometry of the layer of adhesive or wax interposed between the lens and the support in fact takes on a haphazard nature or in any case is difficult to control and may experience deformations, in compression and torsion, during the surfacing operations under the effect of the stresses generated by the surfacing tool.

Finally, lens-blocking systems using a pneumatic depression or reduced pressure have been proposed. Such systems use a holder block or pneumatic chuck which, in order to form a kind of controlled-operation vacuum cup, have a cavity bordered by an annular seal against which the preform is brought to bear in order with the cavity and the seal to delimit a chamber in which a relative vacuum is created. The vacuum may be created either in a box containing, for the blocking operation, the holder block and the lens or under the effect of a vacuum pump connected to the cavity of the block via a pneumatic valve.

This pneumatic blocking solution, also referred to as vacuum blocking, does not have the same economic and environmental disadvantages as the cast or bonded block solutions mentioned previously. Use of this solution is, in effect, particularly simple and quick, both at the blocking and at the unblocking stages, and requires no chemical consumable. However, despite these considerable advantages, this type of blocking is very little used in practice. This is because a lack of precision and stability of the fixing of the lens similar to that observed with the bonded supports is observed. The solution in particular proves difficult to implement for complex surfaces (surfaces other than spherical or toric surfaces) with respect to which the elastically compressible seal does not bear sufficiently precisely and stably. Admittedly, it is then possible to consider increasing the compression stiffness of the seal, but that is at the expense of its coefficient of friction, resulting in a lowering of the torque transmitted for the rotational drive of the lens. This is unless the pressure in the reduced-pressure chamber is reduced in order to increase the intensity of the suction-cup effect applied by the support to the lens, which would carry the risk of deforming the latter.

Document FR2863520 therefore discloses a pneumatic blocking support comprising a central cavity and, around the latter, an annular seal against which the lens is brought to bear. Three projecting pins are provided on the support, on each side of the annular seal, to form a tripod designed to offer the optical lens a rigid footing after the seal has been elastically compressed.

The firmness of the footing of the lens on the tripod thus provides the stability and precision of the geometric positioning of the lens on its support.

The major disadvantage with this solution is that it is not suited to all shapes of lens, notably to lenses the optical faces of which are not very curved and which press against the tripod before the seal is correctly compressed.

These lenses are then found to be held against the seal rather haphazardly.

It is also found that the blocking forces applied to the lens are poorly distributed. The surfacing of the parts of the lens which are situated distant from these pins therefore causes lens deformation that is detrimental to the precision of the machining.

SUBJECT OF THE INVENTION

In order to overcome the aforementioned disadvantages of the prior art, the present invention proposes a novel blocking support which is able to hold the lens firmly and uniformly, whatever the shape of this lens.

More particularly, the invention proposes a blocking support as defined in claim 1.

The translational mobility of these first rods ensures perfect adaptability of the blocking support to the shape of the lens because the return means allow them to be pressed firmly against the lens.

These first mobile rods, the function of which is to support the optical lens, therefore allow the loads applied to this lens to be distributed uniformly, thereby avoiding any lens deformation.

Other advantageous and nonlimiting features of the invention are defined in claims 2 to 13.

DETAILED DESCRIPTION OF ONE EMBODIMENT

The description which will follow with reference to the attached drawings, given by way of nonlimiting example, will make it easy to understand what the invention consists of and how it may be achieved.

In the attached figures:

FIG. 1 is a schematic perspective view of a longitudinal section through a pneumatic blocking support according to the invention;

FIG. 2 is a schematic plan view of a mobile rod of the pneumatic blocking support of FIG. 1;

FIG. 3 is a schematic plan view of a fixed rod of the pneumatic blocking support of FIG. 1;

FIGS. 4 and 5 are schematic perspective and cross-sectional views of a base of the pneumatic blocking support of FIG. 1;

FIGS. 6 and 7 are schematic perspective and cross-sectional views of a sleeve of the pneumatic blocking support of FIG. 1;

FIGS. 8 and 9 are schematic perspective and plan views of a piston of the pneumatic blocking support of FIG. 1; and FIGS. 10 and 11 are schematic perspective and cross-sectional views of a clamping ring of the pneumatic blocking support of FIG. 1.

FIG. 1 depicts a pneumatic blocking support 1 which supports an optical lens 300 and which is fixed to a surfacing machine intended to machine the optical lens 300.

As a preliminary, it will be emphasized that the optical lens 300 may take various forms. It may be an ophthalmic lens to be mounted in a corrective spectacles frame, or a tinted lens to be mounted in a sunglasses frame, or even an objective lens to be mounted in photographic equipment, binoculars, etc.

Similarly, the surfacing machine may take various forms. It may be a machine that removes material (a machine tool, a trimming machine, etc.) or an engraving machine or even a polishing machine, etc. This surfacing machine, whatever its nature, will preferably be intended to operate on one of the faces of the optical lens 300 and possibly on the end face thereof.

As FIG. 1 shows, whatever the type of optical lens 300 and the type of surfacing machine, the pneumatic blocking support 1 comprises a folding part 10 for fixing it to a corresponding member 200 of the surfacing machine, and a blocking part 100 to hold and firmly block the optical lens 300.

This pneumatic blocking support 1 is more specifically designed to immobilize the optical lens 300 whatever the loads applied to it by the tools of the surfacing machine.

At this stage, it may be emphasized that, in the remainder of the description, the terms "front" and "rear" will be used with respect to this optical lens 300, the front of an element denoting the side of this element that faces toward the optical lens 300 and the rear denoting the side of this element facing away.

The holding part 10 will not be described in detail here given that its shape will essentially be dependent on that of the corresponding member 200 of the surfacing machine.

It may thus, as can be seen in FIG. 1, take the form of two superposed rings 11, 12, fixed to the blocking part 100 of the pneumatic blocking support 1.

The present invention relates more to this blocking part 100.

The latter comprises a body 110 from which there project stops 150, 160 arranged to offer the optical lens 300 a firm footing. It also comprises a seal 170 against which the optical lens 300 is made to bear so as to delimit with the body 110 a reduced-pressure chamber 180.

According to a particularly advantageous feature of the invention, the aforementioned stops comprise first rods 160 (referred to as "mobile rods") which are mounted with translational mobility with respect to the body 110 so as to come to bear via their front ends 161 against the optical lens 300, and return means 179, 190 are provided for returning these mobile rods 160 against the optical lens 300.

Here, these return means 179, 190 are partly mechanical and partly pneumatic. They will be described in detail later on in the description.

Advantageously, second rods 150 (referred to as "fixed rods") are also provided and these are mounted translationally fixed with respect to said body 110 and have front ends 151 against which the optical lens 300 is intended to come to bear.

In the invention embodiment depicted in the figures, the body 110 takes the form of three superposed parts, namely (from the rear toward the front) a base 140, a sleeve 130 and a piston 120.

There is also provided, to the rear of the base 140, a clamping ring 101 which acts as an operating means for compressing the piston 120 against the sleeve 130, the effect of which will be to block the mobile rods 160.

These various elements, their layout and operation, will be described in detail further on in this description.

The mobile rods 160 and the fixed rods 150 are preferably uniformly distributed over the front face of the body 110, so that they form a footing for the optical lens 300 which best distributes the loadings they apply to this lens. During the machining operations, the stresses in the optical lens 300 are thereby reduced.

The fixed rods 150 are three in number here and are all identical. They are evenly distributed about the longitudinal and central axis of the body 110 (referred to as the axis A1) and together form a tripod supporting the optical lens 300.

The mobile rods 160 are preferably at least twice as numerous. In this instance, there are fourteen mobile rods 160, all identical.

FIG. 2 depicts one mobile rod 160 in detail. This mobile rod 160 has the shape of a cylinder of revolution about an axis A2, with a domed front end 161, here of hemispherical shape, and a flat rear end 162. Its free front end 161 is designed to project into the reduced-pressure chamber 180 in order to form a seating for the optical lens 300.

This mobile rod 160 has, at its rear end, a peripheral groove 163 intended to accommodate a circlip 164 (see FIG. 1).

A fixed rod 150 is depicted in detail in FIG. 3. This fixed rod 150 has the shape of a cylinder of revolution about an axis A3, with a domed front end 151, here of hemispherical shape, and a flat rear end 152. This fixed rod 150 has a length strictly shorter than that of the mobile rods 160.

Here, the mobile rods 160 and the fixed rods 150 are made from a robust material, for example a metallic material.

In order to prevent these mobile rods 160 and these fixed rods 150 from scratching the optical lens 300 resting against them, the front ends 151, 161 of these rods are all covered with a cap made of a soft material, for example of rubber.

As can be seen in FIG. 1, the base 140 is intended to house the rear ends 162 of the mobile rods 160.

This base 140 is more particularly depicted in FIGS. 4 and 5.

It comprises a cylindrical block 141 of revolution about the axis A1, bordered at the rear by an annular and flat flange 142 exhibiting symmetry of revolution about this axis A1.

This flange 142 is pierced with six openings 143 which are evenly distributed about the axis A1. These six openings are screw holes, so that the flange 142 and the sleeve 130 can be held together notably when the other parts of the blocking support 1 are being dismantled, so that the springs do not leave their housings.

The cylindrical block 141 for its part is pierced with fourteen blind holes 144 with axes parallel to the axis A1, opening only onto the planar front face of this cylindrical block 141.

As shown more particularly in FIG. 1, these blind holes 144 are able to accommodate the rear ends 162 of the mobile rods 161 so that the latter remain free to slide parallel to the axis A1.

These blind holes 144 have a diameter strictly greater than that of the mobile rods 160. They thus house compression springs 179 into which the rear ends 162 of the mobile rods 160 are slipped and which fit between the bottoms of the blind holes 144 and the circlips mounted in the peripheral grooves 163 of the mobile rods 160. These compression springs 179 form mechanical return means for returning the mobile rods 160 forward, namely against the optical lens 300.

As may be seen from FIG. 1, the cylindrical block 141 of the base 140 is designed to be engaged inside the sleeve 130.

This sleeve 130 is more particularly depicted in FIGS. 6 and 7.

It has a rear block 131 which overall is a cylinder of revolution about the axis A1, surmounted by a smaller-diameter thick front disk 132.

The rear block 131 has a diameter equal to that of the flange 142 of the base 140, so that their lateral faces extend in the continuation of one another.

In order to accommodate the cylindrical block 141 of the base 140, the rear block 131 of the sleeve 130 has a cavity 135 recessed into its rear face, in the shape of a cylinder of revolution about the axis A1 and of a diameter equal, to within the mounting clearance, to the diameter of the cylindrical block 141 of the base 140.

This cavity 135 has a depth greater than the height of the cylindrical block 141 of the base 140 so that once the latter is mounted inside the former, the base 140 and the sleeve 130 together delimit a compression chamber 190.

The sleeve 130 has passing through it fourteen through-holes 134 the axes of which coincide with the axes of the blind holes 144 of the base 140, for the passage of the mobile rods 160. These through-holes 134 are shaped as cylinders of revolution of a diameter equal, to within the operating clearance, to the diameter of the mobile rods 160.

These through-holes 134 all open to the rear into the cavity 135. The bottom of the cavity 135 thus forms a stop for the circlips 164 mounted on the mobile rods 160, thereby preventing the latter from being able to be extracted from the body 110.

These through-holes 134 also open onto the front face of the front disk 132 of the sleeve 130. They are flared at this front face so as to accept annular seals 139 (FIG. 1).

The sleeve 130 is also designed to house the rear ends 152 of the fixed rods 150.

Its front disk 132 is therefore pierced with three blind holes 136 with axes parallel to the axis A1, which open only onto the planar front face of this front disk 132 (see FIG. 6).

These blind holes 136 have diameters equal, to within the mounting clearance, to the diameter of the fixed rods 150 so that the latter can be forcibly engaged in the blind holes 136 so as to be blocked therein in a fixed position.

As FIG. 6 shows, the rear block 131 has two slots 137 recessed into its lateral face, and situated diametrically opposite one another about the axis A1.

As FIG. 1 clearly shows, the sleeve 130 delimits two air circulation ducts 181, 191 which respectively start at these two slots 137 and which open, one of them, into the bottom of the cavity 135 and the other onto the front face of the front disk 132.

The mouths of these two ducts 181, 191, which mouths are situated at the slots 137, are equipped with means of connection to two air circulation hoses (not depicted).

One of these ducts 191 is thus designed to be connected to a raised-pressure pump with which the surfacing machine is equipped, whereas the other duct 181 is designed to be connected to a vacuum pump with which the surfacing machine is likewise equipped.

The raised-pressure pump makes it possible to raise the pressure of the air present in the raised-pressure chamber 190, this having the effect of pushing the mobile rods 160 forward so as to bring them back into contact with the optical lens 300. This raised-pressure chamber therefore forms a pneumatic return means for returning the mobile rods 160 forward.

The vacuum pump on the other hand makes it possible to reduce the pressure of the air present in the reduced-pressure chamber 180, this having the effect of pressing the optical lens 300 firmly against the seal 170 and against the front ends 151, 161 of the mobile rods 160 and of the fixed rods 150.

The two air-circulation ducts 181, 191 are in this instance each equipped with a shutoff valve 182, 192 making it possible, when the hoses are disconnected, automatically to block the circulation of air. These shutoff valves 182, 192 allow a pressure in excess of 2 bar to be maintained in the raised-pressure chamber 190 and a pressure of less than 0.1 bar to be maintained in the reduced-pressure chamber 180 after the hoses have been disconnected.

In this way, while the optical lens 300 is being machined, even though the pneumatic blocking support 1 generally describes a number of revolutions about the axis A1, the hoses will not become entangled or impede the rotation of the support.

In FIG. 7 it may be seen that the rear face of the rear block 131 has, uniformly distributed about the cavity 135, blind holes 133 situated along the axis of the openings 143 of the base 140. These blind holes 133 are tappings into which the screws that pass through the holes 143 of the base 140 can be screwed in order to hold the sleeve 130 and the base 140 together and guarantee the mounting of the springs and rods.

It may also be seen that the lateral face of the front disk 132 of the sleeve 130 has a peripheral groove 137.

As shown more particularly by FIG. 1, this peripheral groove 137 is designed to block the seal 170.

This seal 170 here takes the form of a gaiter. It has a front edge against which the optical lens 300 rests, and a rear edge internally provided with a peripheral rib engaged in the peripheral groove 137 of the sleeve.

As can be seen in FIG. 1, the sleeve 130 is intended to come into contact, via the front face of its front disk 132, with the piston 120.

This piston 120 is more particularly depicted in FIGS. 8 and 9.

It comprises a disk 121 of revolution about the axis A1 and of diameter equal to that of the front disk 132 of the sleeve 130, so that their lateral faces respectively extend in the continuation of one another.

It also comprises a shaft 122 of revolution about the axis A1 which extends from the center of the rear face of the disk 121, toward the rear.

The disk 121 has seventeen through-holes 124 the axes of which coincide with the through-holes 134 and the blind holes 136 of the sleeve 130, for the passage of the mobile rods 160 and of the fixed rods 150. These through-holes 124 are shaped as cylinders of revolution with diameters equal, to within the operating tolerance, to the diameter of the mobile rods 160 and of the fixed rods 150.

It also has an eighteenth through-hole 125 situated in the continuation of the duct 181, so as to allow the latter to communicate with the reduced-pressure chamber 180.

The shaft 122 passes through central holes 138, 148 provided through the sleeve 130 and the base 140. It has a diameter equal, to within the operating clearance, to the diameter of these central holes 138, 148. In this way, the piston 120 remains translationally mobile with respect to the sleeve 130 along the axis A1.

The shaft 122 has two peripheral grooves 123 exhibiting symmetry of revolution about the axis A1 and situated in such a way that they are located respectively level with these two central holes 138, 148. They accept O-ring seals which prevent the air situated in the raised-pressure chamber 190 from escaping.

The shaft 122 is designed to project to the rear of the base 140 via its rear end.

Its rear end has two threaded parts 125, 126 of different diameters.

One of these parts 125, the one situated furthest forward and having the greater diameter, accepts the aforementioned clamping ring 101, whereas the other part 126 is forcibly screwed into a tapped bore provided accordingly in the rings 11, 12 of the holding part 10.

In this instance, the clamping ring 101 takes the form of a disk, with a tapped central hole screwed onto the threaded part 125 of the shaft 122 of the piston 120.

Its lateral face is in fact serrated to make it easier to screw on by hand.

The clamping ring 101 further comprises two cutouts 103, in this instance formed by two coaxial blind holes 103 which open one on each side of its lateral face. These two cutouts 103 allow the clamping ring 101 to be forcibly screwed onto or unscrewed from the piston 120, using a pin wrench.

This clamping ring 101 therefore forms an operating means suited to pushing the piston 120 against the sleeve 130.

In this way, when the clamping ring 101 is screwed on, the piston 120 is pushed against the sleeve 130, thereby compressing the O-ring seals 139. The latter therefore find themselves in a state referred to as the blocking state, in which they block the sliding of the mobile rods 160.

By contrast, when the clamping ring 101 is unscrewed, the elasticity of the O-ring seals 139 allows the piston 120 to move away from the sleeve 130, thereby allowing said O-ring seals 139 to relax into a state referred to as the release state, in which they leave the mobile rods 160 free to slide forward or backward.

The pneumatic blocking support 1 is therefore used as follows.

Via its holding part 10 it is first of all fixed to the corresponding member 200 of the surfacing machine.

The air circulation hoses are then engaged in the connection means provided for that purpose on the sleeve 130.

The user then positions the optical lens 300 via its front face against the seal 170 such that it bears against the tripod formed by the front ends 151 of the three fixed rods 150.

He then switches on the two pumps of the surfacing machine.

In this way, the raised-pressure pump establishes a pressure in excess of 2 bar in the raised-pressure chamber 190, this having the effect of pushing the mobile rods 160 against the front face of the optical lens 300. The vacuum pump on the other hand establishes a pressure of less than 0.1 bar in the reduced-pressure chamber 180, this having the effect of holding the optical lens 300 bearing against the front ends 151, 161 of the various mobile rods 160 and fixed rods 150.

The user then uses a pin wrench to screw the clamping ring 101 onto the piston 120, so as to block the mobile rods 160 in a fixed position.

He then disconnects the two hoses, this having the effect of automatically closing the shutoff valves 182, 192 of the two ducts 181, 191. Thus, the low pressure in the reduced-pressure chamber remains, allowing the optical lens 300 to be held firmly in place.

The pneumatic blocking support 1 is then free to pivot during the operations of machining the optical lens 300, without being impeded by the hoses.

The present invention is not in any way restricted to the embodiment described and depicted, and a person skilled in the art will know how to vary it in any way in accordance with its spirit.

Thus, provision could have been made for the pneumatic blocking support not to comprise any fixed rod, just mobile rods. It is also possible for it to comprise just one or two fixed rods.

Provision could also have been made for the mobile rods to have been returned forward, into contact with the optical lens, using compression springs alone, in which case there would be no need for the surfacing machine to comprise a raised-pressure pump.

By contrast, provision could have been made for the mobile rods not to have been returned forward, into contact with the optical lens, using the raised-pressure chamber alone, in which case no compression spring in the base would have been provided.

Provision could also have been made for the means that compress the piston against the sleeve to have taken a different form. Thus, for example, these could have been pneumatic or electromagnetic means.

The invention claimed is:

1. A pneumatic blocking support for blocking an optical lens on a surfacing machine, comprising:

a holding part for fixing it to a corresponding member of said surfacing machine, and a lens-blocking part for blocking said optical lens and which comprises a body from which there project stops arranged to offer the optical lens a rigid footing, and a seal against which the optical lens is able to be made to bear so as to delimit with said body a reduced-pressure chamber, wherein said stops comprise first rods which are mounted with translational mobility with respect to said body so as to come to bear via their free ends against the optical lens, and return means are provided for returning said first rods against the optical lens.

2. The pneumatic blocking support as claimed in claim 1, wherein said return means comprise, inside said body, a raised-pressure chamber which houses part of each first rod and which is configured in such a way that a raised pressure in the raised-pressure chamber generates thrust on said first rods, toward the optical lens.

3. The pneumatic blocking support as claimed in claim 2, wherein said body delimits an air circulation duct which opens into said raised-pressure chamber and which is equipped with a shutoff valve designed to block the circulation of air in said duct.

4. The pneumatic blocking support as claimed in claim 1, wherein said return means comprise springs each interposed between part of each first rod and part of said body in such a way that they generate thrust on said first rods toward the optical lens.

5. The pneumatic blocking support as claimed in claim 1, wherein said stops comprise second rods which are mounted translationally fixed with respect to said body and which have free ends against which the optical lens is intended to come to bear.

6. The pneumatic blocking support as claimed in claim 5, wherein exactly three second rods are provided, which together form a tripod supporting said optical lens.

7. The pneumatic blocking support as claimed in claim 1, wherein stop means are provided, which are designed to adopt two states alternately, one state being a blocking state in which they translationally block each of said first rods with respect to the body, and one state being a release state in which they release each of said first rods in terms of translation with respect to the body.

8. The pneumatic blocking support as claimed in claim 1, wherein said first rods are mounted with translational mobility on the body along parallel axes of translation.

9. The pneumatic blocking support as claimed in claim 7, wherein:

said first rods are mounted with translational mobility on the body along parallel axes of translation, the body comprises a sleeve and a piston through which said first rods pass and which are mounted with translational mobility relative to one another along an axis parallel to the axes of translation of said first rods, said stop means comprise deformable rings each slipped over one of said first rods so as to be interposed between the sleeve and the piston, and an operating means is provided and is designed to push the piston against the sleeve to compress the deformable rings from their release state into their blocking state.

10. The pneumatic blocking support as claimed in claim 9, wherein said operating means comprises a nut screwed into a threaded rod of said piston which passes through said sleeve.

11. The pneumatic blocking support as claimed in claim 1, wherein said body delimits an air circulation duct which opens into said reduced-pressure chamber and which is equipped with a shutoff valve designed to block the circulation of air in said duct.

12. The pneumatic blocking support as claimed in claim 1, wherein at least six first rods are provided.

13. The pneumatic blocking support as claimed in claim 1, wherein the free end of each first rod comprises a flexible cap.

* * * * *